US009437360B2

(12) United States Patent
Yang

(10) Patent No.: US 9,437,360 B2
(45) Date of Patent: Sep. 6, 2016

(54) STRUCTURE OF TRANSFORMER

(71) Applicant: Sen-Tai Yang, New Taipei (TW)
(72) Inventor: Sen-Tai Yang, New Taipei (TW)
(73) Assignee: YUJING TECHNOLOGY CO., LTD., New Taipei (TW)

( * ) Notice: Subject to any disclaimer, the term of this patent is extended or adjusted under 35 U.S.C. 154(b) by 78 days.
(21) Appl. No.: 14/578,460
(22) Filed: Dec. 21, 2014
(65) Prior Publication Data
US 2015/0302979 A1 Oct. 22, 2015
(30) Foreign Application Priority Data
Apr. 22, 2014 (TW) ..... 103114563 A
(51) Int. Cl.
*H01F 27/02* (2006.01)
*H01F 27/30* (2006.01)
*H01F 27/29* (2006.01)
*H01F 27/32* (2006.01)
(52) U.S. Cl.
CPC ..... *H01F 27/325* (2013.01); *H01F 27/025* (2013.01); *H01F 27/306* (2013.01); *H01F 2027/297* (2013.01)
(58) Field of Classification Search
CPC .... H01F 27/325; H01F 27/025; H01F 27/29; H01F 27/306
USPC ..... 336/198, 192, 59, 83
See application file for complete search history.

(56) References Cited

U.S. PATENT DOCUMENTS 5,008,644 A * 4/1991 Cooper ..... H01F 5/04 336/192
6,734,777 B2 * 5/2004 Yeh ..... H01F 27/324 336/198
6,781,499 B2 * 8/2004 Steiner ..... H01F 27/292 336/192
7,449,986 B2 * 11/2008 Yamaguchi ..... H01F 5/04 336/192
8,031,040 B1 * 10/2011 Folker ..... H01F 5/02 336/192
2007/0246594 A1 * 10/2007 Pan ..... H01F 21/04 242/474.4
2009/0315661 A1 * 12/2009 Teng ..... H01F 27/292 336/192
2011/0037554 A1 * 2/2011 Tsai ..... H01F 27/06 336/196
2011/0115594 A1 * 5/2011 Yen ..... H01F 27/027 336/192
2011/0260820 A1 * 10/2011 Liao ..... H01F 27/325 336/192
2013/0249665 A1 * 9/2013 Liu ..... H01F 5/04 336/208
2014/0001976 A1 * 1/2014 Park ..... H01F 5/04 315/276

* cited by examiner

*Primary Examiner* — Elvin G Enad
*Assistant Examiner* — Kazi Hossain
(74) *Attorney, Agent, or Firm* — Pro-Techtor International Services; Ian Oglesby

(57) ABSTRACT

An improved structure of a transformer includes a bobbin covering at least a portion of a magnetic core set which has a magnetic loop passing through the bobbin, wherein winding grooves and at least one connecting portion extending sideways are provided on the outer peripheral side of the bobbin, and a plurality of notches with lateral openings are provided on the connecting portion. Coils are wound in the winding grooves of the bobbin. The coils have at least a plurality of line ends, each line end passing through a different notch. One positioning pin is embedded in each of the winding grooves near the lateral opening. The positioning pins hold the respective line ends in place by pressing against them. A casing is fitted on the outer peripheral side of the coils to create separation between the coils and the magnetic core set. The casing is provided with a hollow opening such that the outer peripheral side of the coils facing the airflow is exposed to improve the overall heat dissipating efficiency.

9 Claims, 6 Drawing Sheets

STRUCTURE OF TRANSFORMER

BACKGROUND OF THE INVENTION

1. Field of the Invention

The invention relates to an improved structure of a transformer, and more particularly, to a transformer structure that simplifies assembly, reduces contact impedance, and ensures the distance between the outer peripheral side of the coils and the magnetic cores is in compliance with the safety regulations.

2. Description of the Prior Art

One basic structure of a traditional transformer is formed by winding coils (primary and secondary windings) onto the periphery of a bobbin, and providing an insulating layer on the outer periphery side of the coils (which can be several turns of insulating tapes or papers wound onto the coils), then combining the bobbin including the coils with magnetic cores. In addition, a plurality of terminals are inserted onto the bobbin, and the line ends of the windings of the coils are then soldered onto the terminals, thus completing the assembly of the transformer.

However, the above transformer has the following shortcomings:

1. Since the line ends of each winding of the coils are connected to the terminals by soldering, the overall process is more complicated and more costly to produce. For smaller transformer products with lower prices, this type of transformer is not economical.
2. Since the line ends of each winding of the coils are first wound and then soldered onto the terminals. For transformers of a smaller size and large current output which tend to have thicker secondary windings, the windings may create short circuits with the neighboring terminals, thus degrading the quality of the products.
3. Since the line ends of each winding of the coils are soldered onto the terminals, and the transformer is soldered onto the circuit board or other relevant components through the terminals, the terminals and their soldering parts may increase the contact impedances, thus degrading the efficiency and characteristics of the transformer.
4. The insulating layer formed by winding several turns of insulating tapes or papers onto the outer peripheral side of the coils is not only difficult to handle in the manufacturing process, the complete enclosure of the coils also hinders heat dissipation, thereby degrading the electrical characteristics of the product.

In view of the shortcomings in the conventional transformer structure, the present invention is proposed to provide improvements that address these shortcomings.

SUMMARY OF THE INVENTION

One main objective of the present invention is to provide an improved structure of a transformer, in which the line ends of coils are threaded through notches on a bobbin, and each of the line ends is held in place by a positioning pin with a bevel face embedded in the notch, such that each line end also functions as a terminal. Meanwhile, the bevel face on the positioning pin is capable of fastening line ends of different diameters, thus simplifying the assembly process and reducing the production cost.

Another objective of the present invention is to provide an improved structure of a transformer, in which the line ends of coils are directly connected with the circuit board or other relevant components without the need of connecting through traditional terminals and second soldering structures. As a result, the contact impedance between the output leads of the coils and the circuit board or other relevant components is lower, improving the electrical characteristics and competitiveness of the product.

Another objective of the present invention is to provide an improved structure of a transformer, in which the outer peripheral side of coils is covered by a casing to ensure the distance between the coils and magnetic cores is in compliance with the safety regulations. Additionally, an appropriate hollow opening is provided on the casing to increase the overall heat dissipating efficiency.

In order to achieve the above objectives and efficacies, the technical means employed by the present invention may include: a magnetic core set composed of a plurality of magnetic cores; a bobbin covering at least a portion of the magnetic core set which has a magnetic loop passing through the bobbin, wherein winding grooves and at least one connecting portion extending sideways are provided on the outer peripheral side of the bobbin, and a plurality of notches with lateral openings are provided on the connecting portion, each notch being provided with a positioning pin near the later opening; coils wound in the winding grooves of the bobbin, wherein the coils have at least a plurality of line ends, each line end passing through a different notch and positioned by a positioning pin which pressed on a side thereof; and a casing fitted on the outer peripheral side of the coils to form an insulating shield between the coils and the magnetic core set, wherein the casing is provided with a hollow opening such that the outer peripheral side of the coils facing the airflow is exposed.

In the above structure, a positioning pin is embedded in each notch, and a combining portion is provided on at least one side of each notch near the lateral opening, while a corresponding combined portion that is mated with the combining portion is provided on at least one side of each positioning pin so as to position the positioning pin inside the notch.

In the above structure, the combining portion is a guiding groove, and the combined portion is a flange that is capable of being slid into the guiding groove.

In the above structure, the casing is composed of two symmetric shielding portions combined by a joining portion, and the hollow opening is disposed between the two shielding portions.

In the above structure, a bevel face is provided on one side of each positioning pin near the respective notch.

In the above structure, a concave camber is provided at one side of each positioning pin near the notch.

In the above structure, an insulating sheath is provided on the outer peripheral side of each of the line ends at a location corresponding to the notch.

In the above structure, a plurality of terminals are provided on the connecting portion of the bobbin.

In the above structure, the positioning pins provided in the notches are combined to form a single structure.

The accomplishment of this and other objectives of the invention will become apparent from the following description and its accompanying drawings of which:

DETAILED DESCRIPTION OF THE PREFERRED EMBODIMENT

Figure 1:
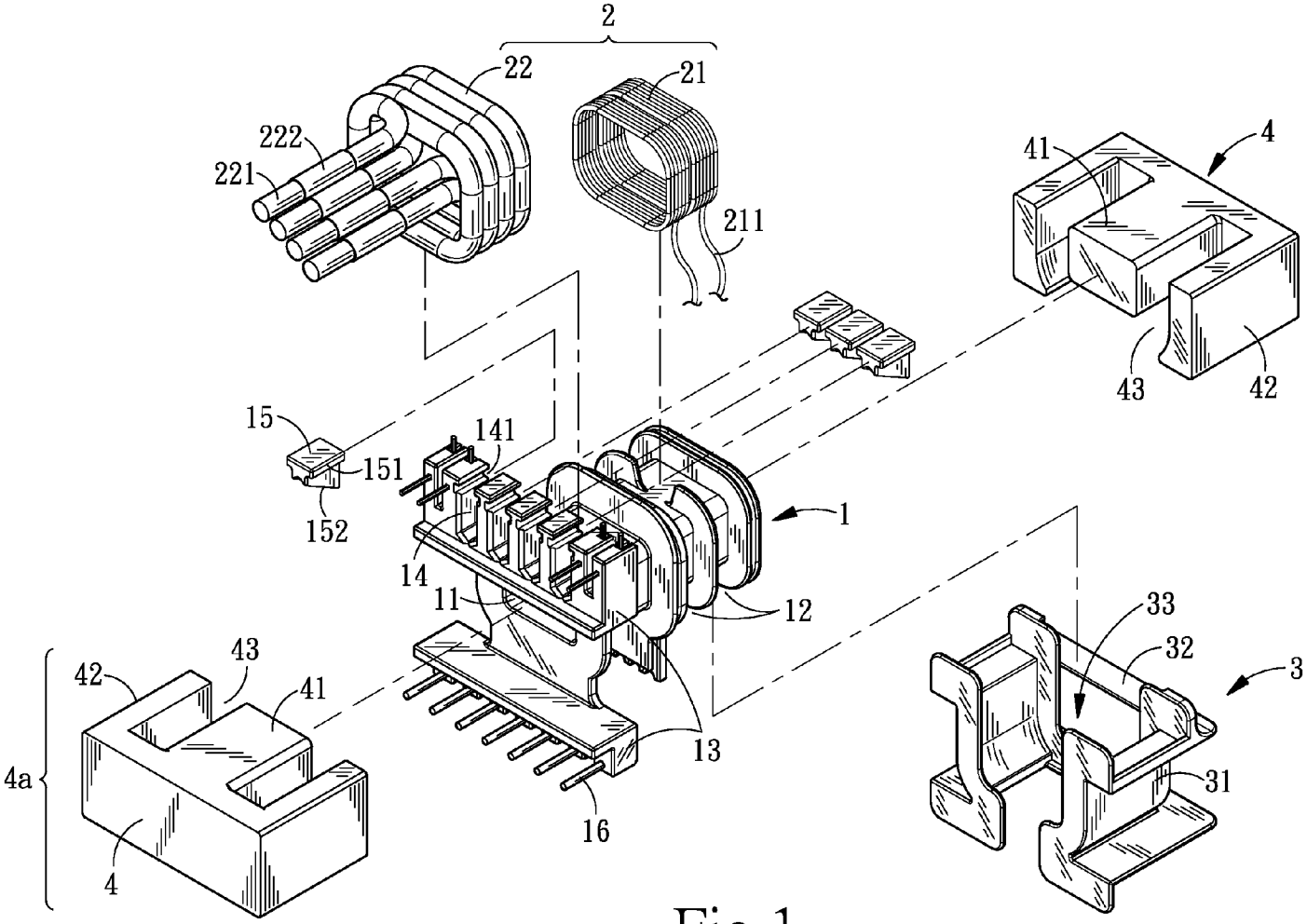
FIG. 1 is an exploded view of the structure in accordance with a first embodiment of the present invention.
Figure 2:
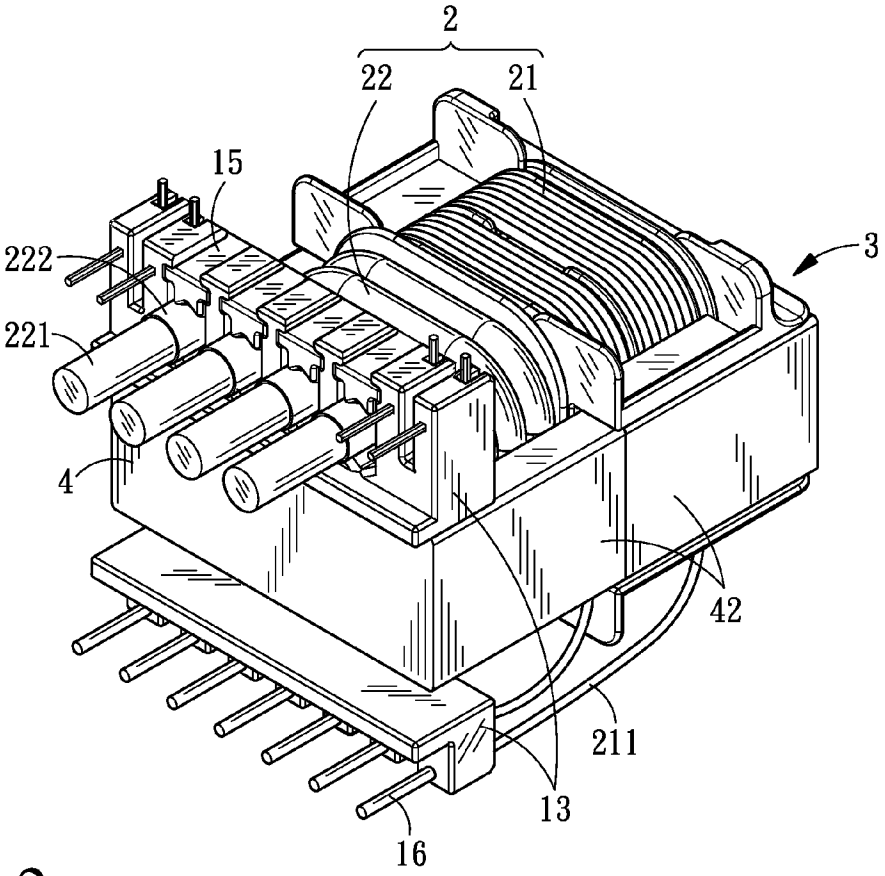
FIG. 2 is a perspective view of the overall assembled structure in accordance with the first embodiment of the present invention.
Figure 3:
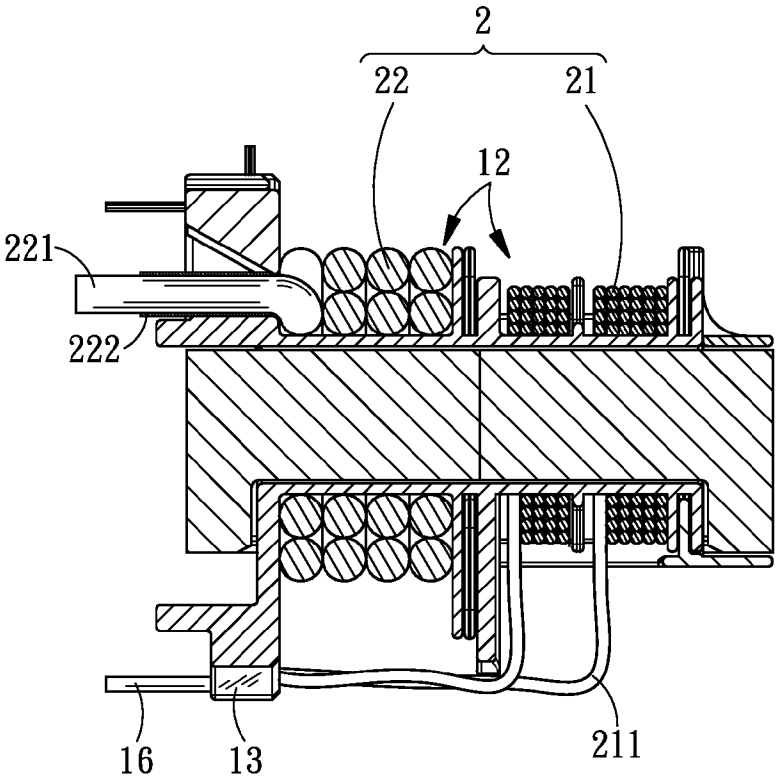
FIG. 3 is a cross-sectional view of the assembled structure in accordance with the first embodiment of the present invention.

Referring to FIGS. 1 to 3, the structure of a first embodiment in accordance with the present invention mainly includes: a bobbin 1, coils 2, a casing 3 and a magnetic core set 4, wherein the bobbin 1 is provided with a center hole 11 that passes through it. At least one winding groove 12 and connecting portion 13*s* extending from two sides of the outer peripheral side of the center hole 11 are provided. A plurality of notches 14 with lateral openings and a plurality of pins 16 are provided on each of the connecting portions 13. Combining portions 141 (which can be guiding grooves) are provided on two sides of each notch 14 near the lateral opening. Additionally, combined portions 151 (which can be side flanges) that can be mated with the combining portions 141 are provided on two sides of a plurality of positioning pins 15, such that the positioning pins 15 provide positioning near the lateral openings within the notches 14.

The coils are wound onto the winding grooves 12 of the bobbin 1 and composed of primary and secondary windings 21 and 22. The primary and secondary windings 21 and 22 include at least one set of line ends 211 and 221, respectively, wherein the line ends 221 of the secondary winding 22 (or the line ends 211 of the primary winding 21) pass through the notches 14, and the positioning pins 15 press against the sides of the line ends 221 (or 211) to achieve positioning and allow the line ends 221 (or 211) to extend in the same direction as the pins 16. Meanwhile, an insulating sheath 222 can be selectively provided on the outer peripheral side of each of the line ends 221 (or 211) to protect the surface thereof.

In one implementation, a bevel face 152 is provided on one side of each positioning pin 15 near the notch 14. The bevel face 152 creates a gradually-increased pressure on the line end 221 when the combined portion 151 of the positioning pin 15 is assembled into the combining portion 141. They provide the benefits of operating convenience and stability for the line ends.

The magnetic core set 4*a* is composed of two symmetric cores 4 opposite to each other. Middle bars 41 are provided in middle portions of the cores 4, and can be inserted into the center hole 11. Corresponding side bars 42 are provided on at least two sides of the middle bars 41. Receiving spaces 43 are formed between the middle bars 41 and the side bars 42 for receiving the winding groove set 12 of the bobbin 1 and the coils 2, such that the two magnetic cores 4 may form a magnetic loop around the bobbin 1 using the middle bars 41 and the side bars 42.

The casing 3 is formed of a long joining portion 32 and two symmetric shielding portions 31. When assembled, the joining portion 32 is placed at one end of the coils 2, so that the two shielding portions 31 are fitted on the outer peripheral side of the coils 2, thereby forming an insulating shield between the coils 2 and the magnetic core set 4*a*. Meanwhile, at least one hollow opening 33 is formed between the two shielding portions 31, so that the outer peripheral side of the coils 2 facing the airflow is exposed, thus increasing the efficiency of heat dissipation of the coils 2.

Figure 4:
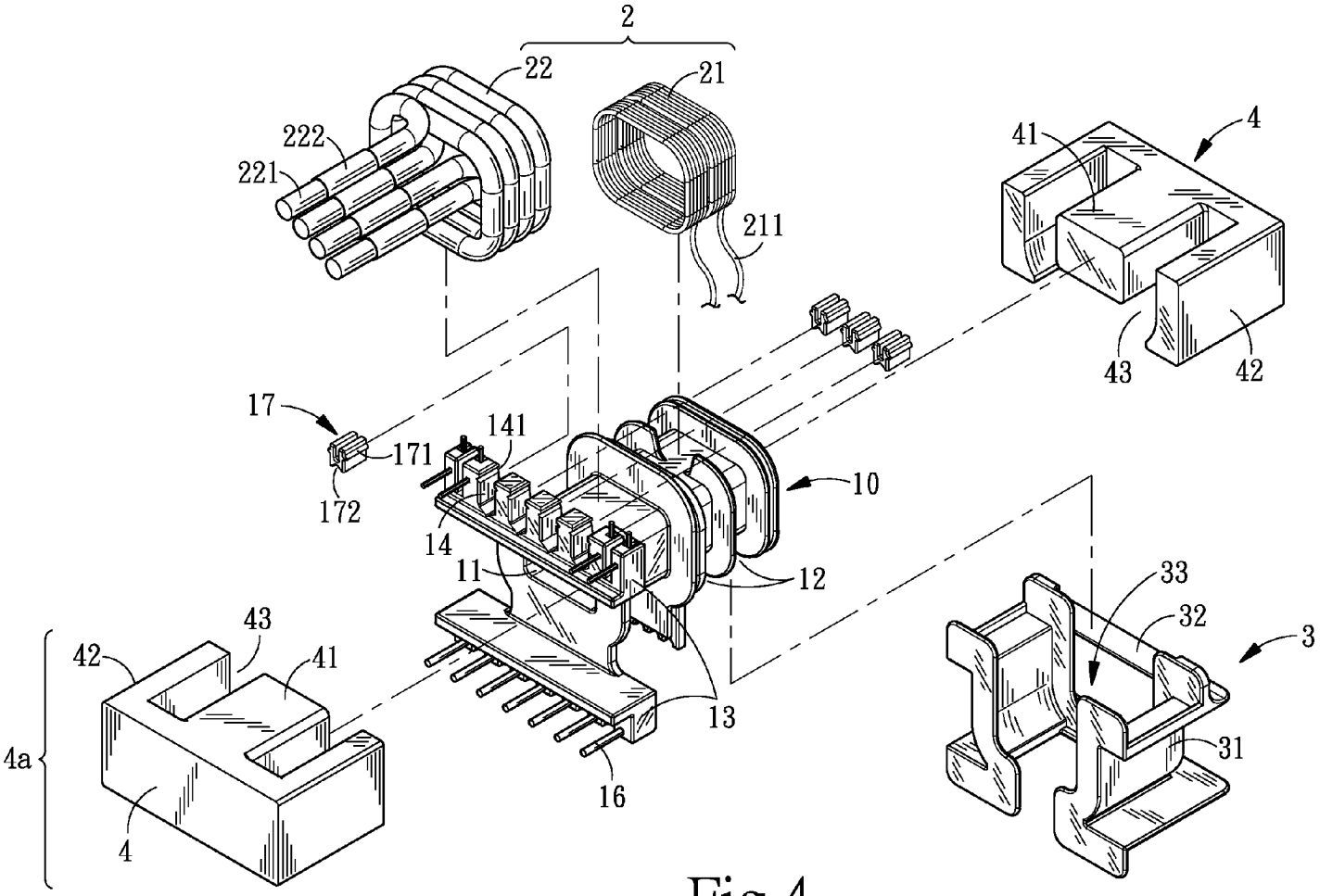
FIG. 4 is an exploded view of the structure in accordance with a second embodiment of the present invention.
Figure 5:
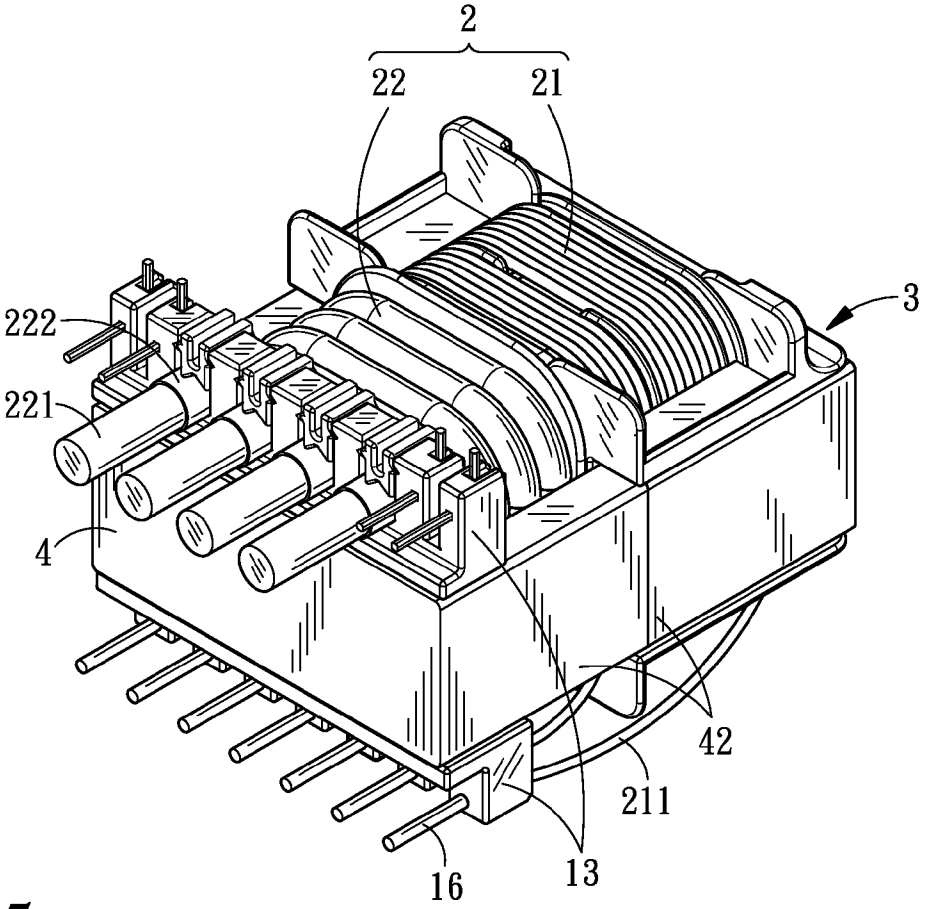
FIG. 5 is a perspective view of the overall assembled structure in accordance with the second embodiment of the present invention.
Figure 6:
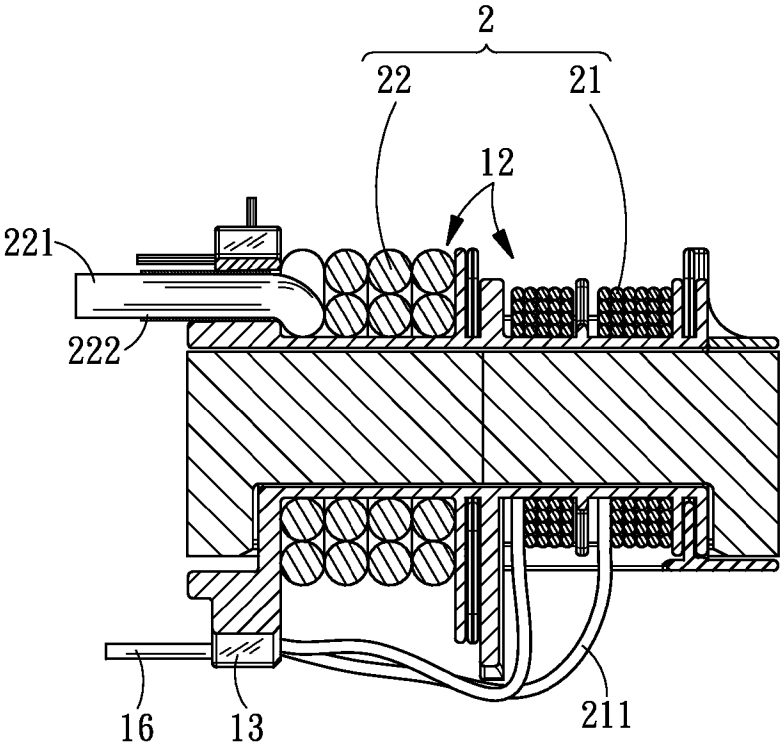
FIG. 6 is a cross-sectional view of the assembled structure in accordance with the second embodiment of the present invention.

Referring now to FIGS. 4 to 6, the structure in accordance with a second embodiment of the present invention mainly includes: a bobbin 10, and components such as the coils 2, the casing 3 and the magnetic core set 4 that are the same as those described in the first embodiment; wherein the bobbin 10 has portions such as the center hole 11, the winding groove 12, the connecting portion 13 and the notches 14 that are the same as those of the bobbin 1; the only difference being that the bobbin 10 has a plurality of positioning pins 17. Combined portions 171 (which can be side flanges) that can be mated with the combining portions 141 are provided on two sides of each positioning pin 17, such that the positioning pins 17 provide positioning near the lateral openings within the notches 14.

In one implementation, a concave camber 172 is provided at one side of each positioning pin 17 near the notch 14. The concave cambers 172 can exert force on the line ends 221 of the coils when the combined portions 17 of the positioning pins 17 are mated with the combining portions 141, so that the line ends 221 can be positioned appropriately.

In the structure of the first or the second embodiment, the positioning pins 15 or the positioning pins 17 can be independent components as described. However, in actual practice, two positioning pins 15 (or the positioning pins 17) can be combined, or even all of the positioning pins 15 (or the positioning pins 17) can be combined into a single structure, which is a variation in application and simplifies the assembly process.

Accordingly, the improved structures of transformers in accordance with the present invention simplifies the assembly process, reduces the contact impedance of the output leads, ensures that the distance between the coils and the magnet cores complies with the safety regulations, and improves the thermal efficiency. In view of the above, the present invention is submitted to be novel and non-obvious and a patent application is hereby filed in accordance with the patent law. It should be noted that the descriptions given above are merely descriptions of preferred embodiments of the present invention, various changes, modifications, variations or equivalents can be made to the invention without departing from the scope or spirit of the invention. It is intended that all such changes, modifications and variations fall within the scope of the following appended claims and their equivalents.

What is claimed is:

1. An improved structure of a transformer, comprising:

a magnetic core set composed of a plurality of magnetic cores;

a bobbin covering at least a portion of the magnetic core set which has a magnetic loop passing through the bobbin, wherein winding grooves and at least one connecting portion extending sideways are provided on the outer peripheral side of the bobbin, and a plurality of notches with lateral openings are provided on the connecting portion, each notch being provided with a positioning pin near the later opening;

coils wound in the winding grooves of the bobbin, wherein the coils have at least a plurality of line ends, each line end passing through a different notch and positioned by a positioning pin which pressed on a side thereof; and a casing fitted on the outer peripheral side of the coils to form an insulating shield between the coils and the magnetic core set, wherein the casing is provided with a hollow opening such that the outer peripheral side of the coils facing the airflow is exposed.

2. The improved structure of a transformer as claimed in claim 1, wherein a positioning pin is embedded in each notch, and a combining portion is provided on at least one side of each notch near the lateral opening, while a corresponding combined portion that is mated with the combining portion is provided on at least one side of each positioning pin so as to position the positioning pin inside the notch.

3. The improved structure of a transformer as claimed in claim 2, wherein the combining portion is a guiding groove, and the combined portion is a flange that is capable of being slid into the guiding groove.

4. The improved structure of a transformer as claimed in claim 1, wherein the casing is composed of two symmetric shielding portions combined by a joining portion, and the hollow opening is disposed between the two shielding portions.

5. The improved structure of a transformer as claimed in claim 1, wherein a bevel face is provided on one side of each positioning pin near the notch.

6. The improved structure of a transformer as claimed in claim 1, wherein a concave camber is provided at one side of each positioning pin near the notch.

7. The improved structure of a transformer as claimed in claim 1, wherein an insulating sheath is provided on the outer peripheral side of each of the line ends at a location corresponding to the respective notch.

8. The improved structure of a transformer as claimed in claim 1, wherein a plurality of terminals are provided on the connecting portion of the bobbin.

9. The improved structure of a transformer as claimed in claim 1, wherein the positioning pins provided in the notches are combined to form a single structure.

* * * * *